US009687719B1

(12) United States Patent
Chen

(10) Patent No.: US 9,687,719 B1
(45) Date of Patent: Jun. 27, 2017

(54) COMPOSITE TRAMPOLINE ENCLOSURE SYSTEM

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 14/975,476

(22) Filed: Dec. 18, 2015

(51) Int. Cl.
*A63B 5/11* (2006.01)
*A63B 71/02* (2006.01)
*A63B 21/02* (2006.01)

(52) U.S. Cl.
CPC ..... *A63B 71/022* (2013.01); *A63B 5/11* (2013.01); *A63B 21/023* (2013.01)

(58) Field of Classification Search
CPC ..... A63B 5/11
See application file for complete search history.

(56) References Cited

U.S. PATENT DOCUMENTS 3,869,120 A * 3/1975 Nissen ..... A63B 5/11 482/27
4,955,309 A * 9/1990 Ciccone ..... B63B 21/20 114/230.24
8,585,557 B2 * 11/2013 Ikegami ..... A63B 71/022 482/27
2014/0243155 A1 * 8/2014 Publicover ..... A63B 5/11 482/29

* cited by examiner

*Primary Examiner* — Sundhara Ganesan
*Assistant Examiner* — Rae Fischer
(74) *Attorney, Agent, or Firm* — Clement Cheng

(57) ABSTRACT

A composite trampoline enclosure system has a trampoline with a trampoline frame and a trampoline bed. The trampoline enclosure is mounted to the trampoline. The trampoline enclosure further includes an enclosure pole formed as a tubular post, and an endcap. The endcap fits over the tubular post. A flexible top line is made of polyethylene or polypropylene. The flexible top line connects to the endcap. The flexible top line supports the trampoline enclosure netting. An extended coil spring is whipped in a helical orientation around an external circumferential periphery of the flexible top line. The trampoline enclosure netting is extended around the trampoline bed. The trampoline enclosure netting is supported by the trampoline pole. The extended coil spring is preferably made of spring steel. The flexible top line is preferably made of a high density polyethylene tube.

6 Claims, 9 Drawing Sheets

COMPOSITE TRAMPOLINE ENCLOSURE SYSTEM

FIELD OF THE INVENTION

The present invention is in the field of trampoline enclosures.

DISCUSSION OF RELATED ART

Trampoline enclosures have become more popular in recent years and may help in retaining users that might otherwise fall off the trampoline bed. A variety of different improvements have been made to trampoline enclosures for improving their strength and stability. Notwithstanding all of the general improvements in trampoline enclosure construction in the past few decades, the trampoline enclosure can still be further improved.

SUMMARY OF THE INVENTION

A composite trampoline enclosure system has a trampoline with a trampoline frame and a trampoline bed. The trampoline enclosure is mounted to the trampoline. The trampoline enclosure further includes an enclosure pole formed as a tubular post, and an endcap. The endcap fits over the tubular post. A flexible top line is made of polyethylene or polypropylene. The flexible top line connects to the endcap. The flexible top line supports the trampoline enclosure netting. An extended coil spring is whipped in a helical orientation around an external circumferential periphery of the flexible top line. The trampoline enclosure netting is extended around the trampoline bed. The trampoline enclosure netting is supported by the trampoline pole. The extended coil spring is preferably made of spring steel. The flexible top line is preferably made of a high density polyethylene tube.

The flexible top line made of high density polyethylene or polypropylene is preferably made with a coil spring slot formed as a helical groove along at least a portion of the length of the flexible top line. The coil spring slot receives the coil spring that is extended into the coil spring slot. An epoxy coating can be applied over the coil spring slot after the coil spring is extended into the coil spring slot.

Figure 1:
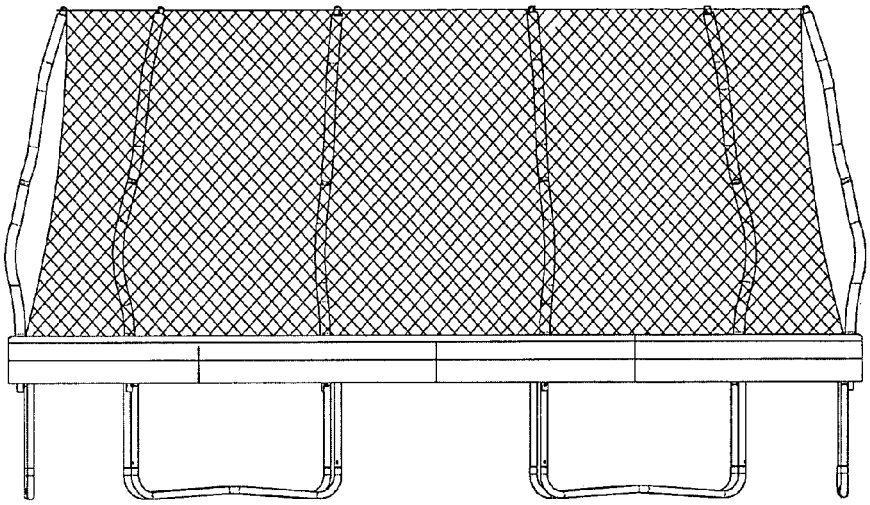
FIG. 1 is a diagram of an enclosure and trampoline.
Figure 2:
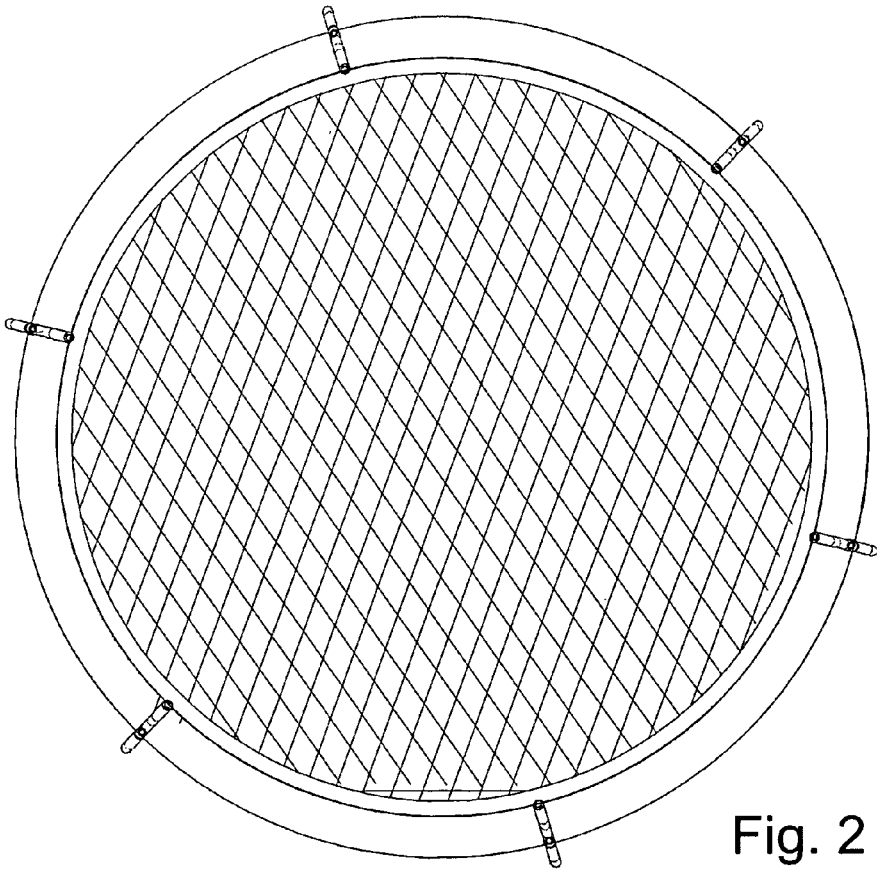
FIG. 2 is a top view diagram of the trampoline.
Figure 3:
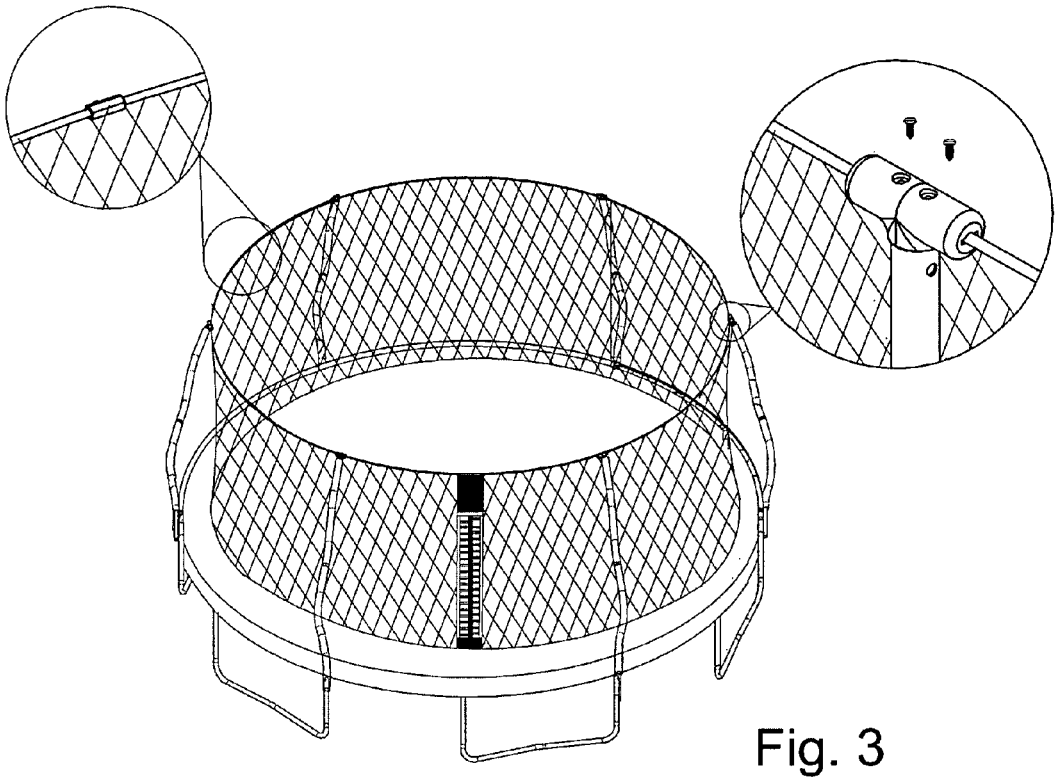
FIG. 3 is a perspective diagram of various connectors used for assembling the trampoline enclosure.
Figure 4:
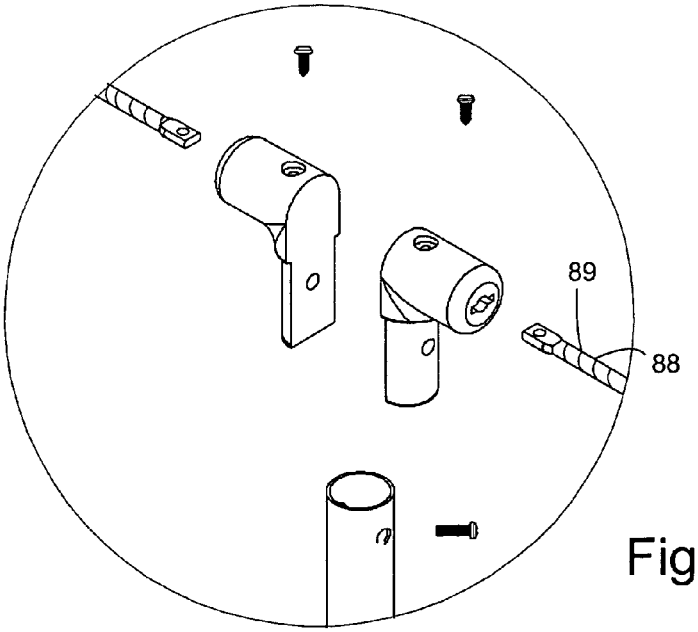
FIG. 4 is a close-up perspective exploded view diagram of a post connector used for assembling the trampoline enclosure.
Figure 5:
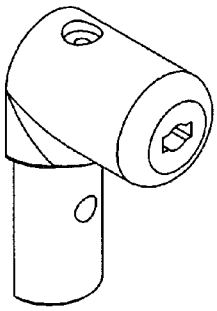
FIG. 5 is a diagram of an enclosure pole top attachment having an arch structure.
Figure 7:
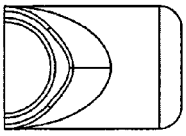
FIG. 7 is a bottom view of a right half of a post connector.
Figure 6:
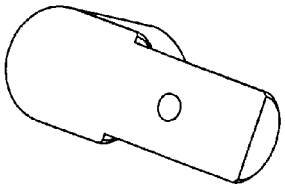
FIG. 6 is a diagram of an enclosure pole top attachment having an arch structure.
Figure 8:
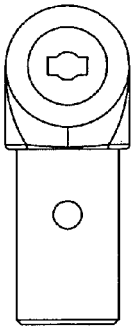
FIG. 8 is a right side view of the post connector.
Figure 9:
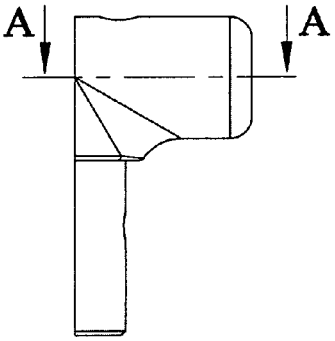
FIG. 9 is a front view of the post connector.
Figure 10:
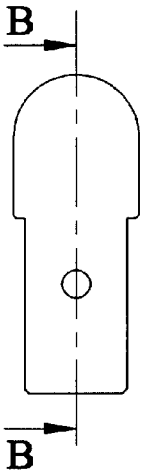
FIG. 10 is a left side view of the post connector.
Figure 11:
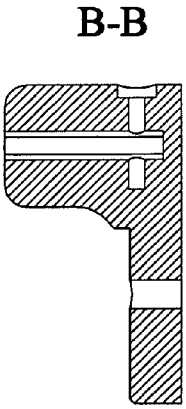
FIG. 11 is a cross-section side view of the post connector.
Figure 12:
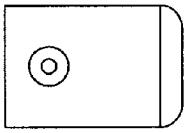
FIG. 12 is a top view of the post connector.
Figure 13:
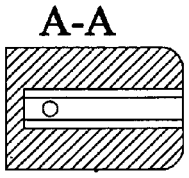
FIG. 13 is a top cross-section view of the post connector.
Figure 14:
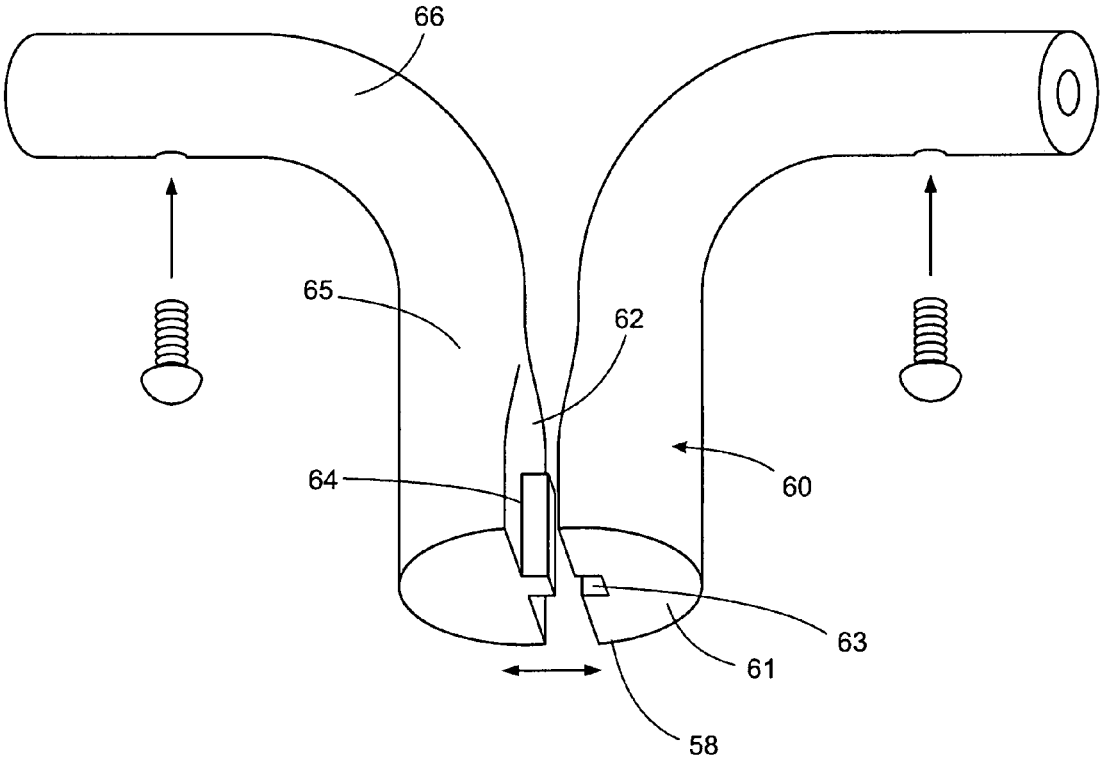
FIG. 14 is a diagram of a post connector that provides an enclosure pole top attachment having an arch structure.

The following call out list of elements can be a useful guide in referencing the elements of the drawings.

20 Enclosure Top Line Member
31 First Top Line Member Connector
32 Second Top Line Member Connector
33 Top Line Member Spring
34 Flexible Top Line
41 Enclosure Pole
42 Enclosure Pole Top Attachment
43 Hook End
44 Inside Prong
45 Outside Prong
46 Endcap
51 Flexible Top Rod
52 Bolt
53 Connector Opening
54 Left Arch Connector
55 Right Arch Connector
56 Rod Socket
57 Rod Tip
58 Interface
60 Post Connector
61 Connection Area Lower Surface
62 Interface Flat Portion
63 Connection Area Indent
64 Connection Area Protrusion
65 Connection Transition
66 Arch Bend
71 Bottom Seam
72 Bottom Seam Top Edge
73 Bottom Seam Fabric Reinforcing Strip
74 Bottom Seam Fabric Reinforcing Strip Openings
75 Bottom Seam Elastic Cord
76 Bottom Seam Elastic Cord Loop
81 Top Seam
82 Top Seam Bottom Edge
83 Top Seam Fabric Reinforcing Strip
84 Top Seam Fabric Reinforcing Strip Openings
85 Top Seam Elastic Cord
86 Top Seam Elastic Cord Loop
88 Coil Spring Retainer
89 Coil Spring Slot
91 Epoxy Coating

DETAILED DESCRIPTION OF THE PREFERRED EMBODIMENT

The trampoline has an enclosure with an enclosure top line member 20 having a first top line member connector 31 at a first end and a second top line member connector 32 at a second end. The flexible top line 34 of the enclosure top line member 20 can be held in tension by a top line member spring 33. The enclosure top line member 20 is connected to the enclosure pole 41 by an enclosure pole top attachment 42.

Figure 20:
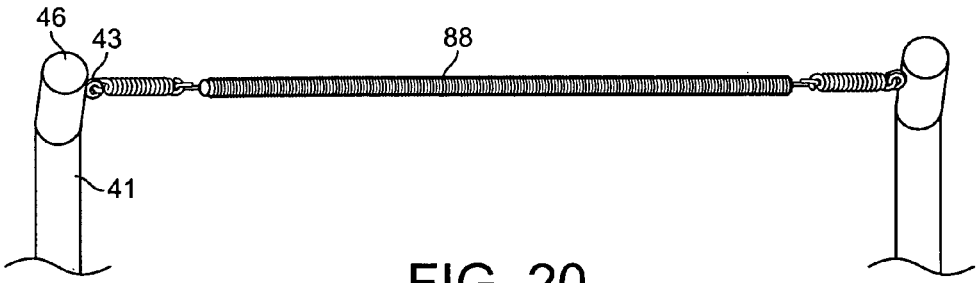
FIG. 20 is a diagram of the enclosure top line member attached to the enclosure pole.
Figure 21:
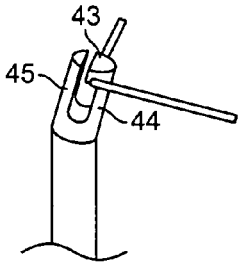
FIG. 21 is a diagram of the enclosure top line member attached to the enclosure pole.
Figure 22:
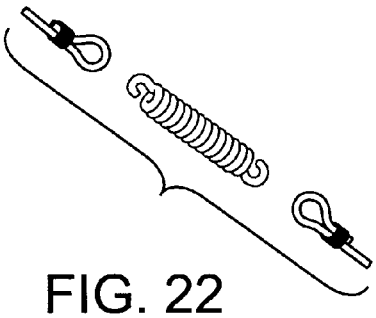
FIG. 22 is a diagram of a hook connection for the spring of the enclosure top line member.
Figure 23:
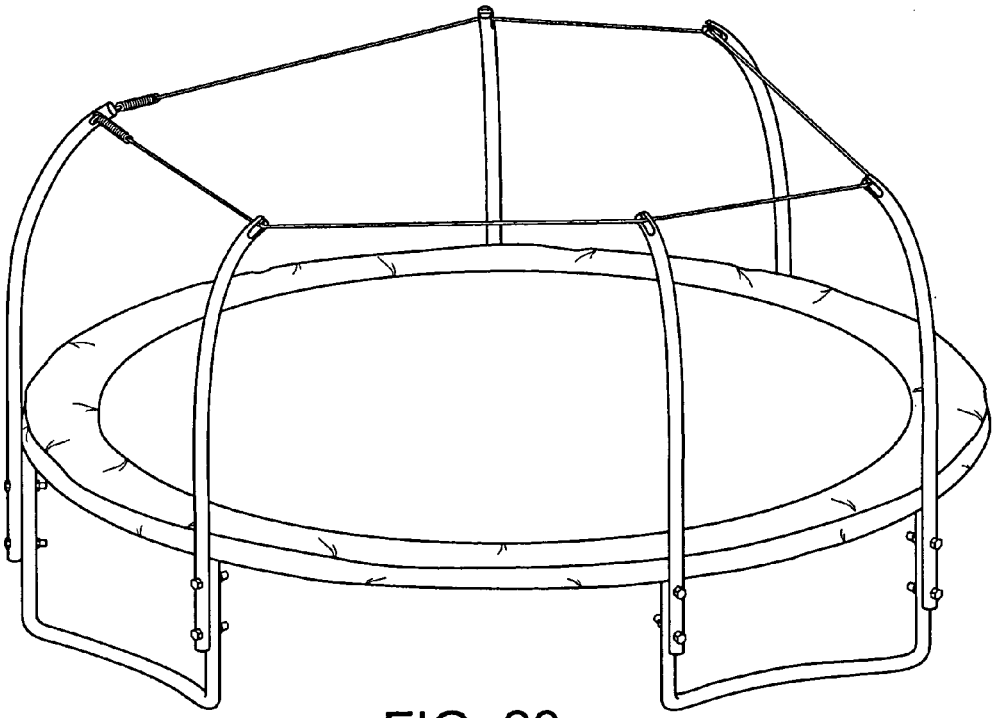
FIG. 23 is a perspective view of the present invention showing the enclosure top line member without the enclosure net attached to the enclosure top line member.
Figure 24:
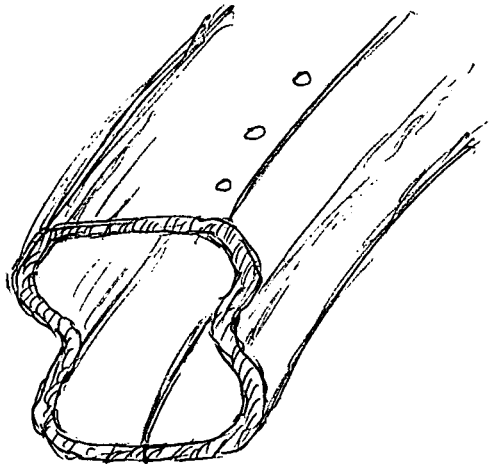
FIG. 24 is a cross section view of the horizontal trampoline frame member.

The enclosure pole can be made of a hollow post such as a vertical bent section of tubular galvanized steel. An upper end of the enclosure pole presents a hollow socket and can receive an endcap 46 made of material such as recycled plastic mixed with color, virgin material, filler and ultraviolet inhibitors. The substantially plastic endcap 46 preferably has a hook end 43 that can be formed as a loop extension made of a connector hardware such as shown in FIG. 20, or can be formed as a slot on the plastic endcap as shown on FIG. 21. The top line member spring 33, FIG. 20 can be hooked to the enclosure pole 41 at a hook end 43. Alternatively, as shown in FIG. 20, the flexible top line 34 can fit in a slot formed between an inside prong 44 and an outside prong 45. The hook end 43 can extend from an upper tip of either the inside prong 44 or the outside prong 45. As seen in exploded view FIG. 22, the top line member spring 33 can be loosely connected to retain to the enclosure top line member 20 by tension forces. As seen in FIG. 23, the top line member can hook onto several trampoline poles before being anchored to one of the trampoline poles.

Figure 15:
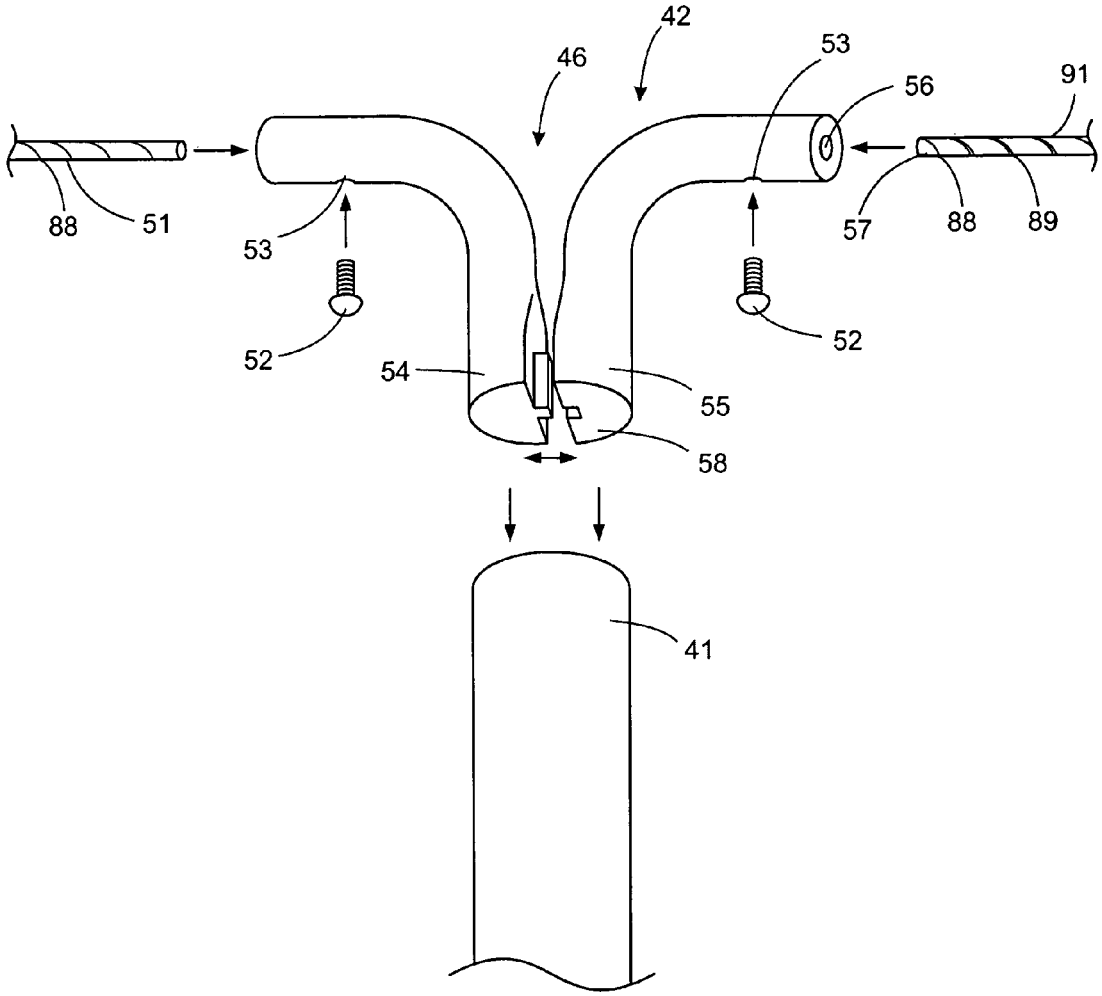
FIG. 15 is a diagram of an enclosure pole top attachment having an arch structure.

As seen in FIG. 15, the endcap 46 can be formed of a left half and a right half assuming it is not integrally formed. The left half can have an extending left arm and the right have can have an extending right arm. The endcap 46 can connect to a flexible top rod 51 made of polyethylene or fiberglass. A key feature of the present invention is that the flexible top rod 51 is wrapped with a coil spring retainer 88. If the flexible top rod 51 is a high density polyethylene tube, an extended coil spring can be whipped around an external circumferential periphery of the high density polyethylene tube in a helical orientation to form a composite material. The coil spring is a metal spring made of spring metal that can be stretched from a condensed state to an extended state that is longer than the condensed state. The extended state of the spring provides a pre-tensioned configuration once the ends of the coil springs are secured to the ends of the high density polyethylene tube. When a user bounces on the trampoline, vibrations in the flexible top rod can be attenuated by both the polyethylene and coil spring. The coil spring slips across the slick high density polyethylene external surface of the flexible top line.

The coil spring retainer 88 is preferably installed by stretching a coil spring in tension to extend to a length of a longer flexible top rod 51. The coil spring retainer 88 can have a round or rectangular cross-section. The polyethylene tube can be formed at least partially along a portion of its length or along an entire portion of its length with a coil spring slot 89 formed as a helical groove or indentation that receives the coil spring retainer 88. The helical groove or indentation can be formed by a rotating extrusion in the case of a coil spring slot 89 being formed along the entire length of the polyethylene tube, or can be formed by cutting away material as in the case of the indentation only being a few turns toward the end of the polyethylene tube, such as seen in FIG. 15. The coil spring retainer 88 can be glued into the helical groove using epoxy for example. The coil spring can be installed easily within the helical groove using specialty tools such as a handheld disk shaped roller. An epoxy coating 91 can be applied over the coil spring slot 89 after insertion of the coil spring into the coil spring slot 89. The epoxy coating 91 can also be applied over the coil even if no coil spring slot 89 is provided. One or more coil springs can be installed to a high density polyethylene tube with or without one or more coil springs slots 89.

Preferably, a hollow high density polyethylene tube wrapped in a coil of spring steel provides a wide flexible range of resilient deformation during normal use, and allows permanent deformation in case of emergency catching of users. After permanent deformation, the flexible top rod 51 needs to be replaced. The top rod 51 is removably secured to the endcap 46. A bolt 52 can pass through a connector opening 53 on either the left arch connector 54 or the right arch connector 55 to clamp a rod tip 57 of the flexible top rod 51 into a rod socket 56.

The endcap 46 is formed of a right arch connector 55 and a left arch connector 54. An interface 58 prevents twisting and can be a puzzle shaped slot in groove configuration, a dovetail joint or the like. The endcap 46 can have an external diameter that fits into the enclosure pole 41 by interference fit. The post connector 60 is preferably formed as an endcap 46 having a pair of arms mounted on arch bends 66. A connection area lower surface 61 can be flat or angled. The interface 58 can have an interface flat portion 62 that has a connection area protrusion 64. The connection area indent 63 is preferably sized to receive the connection area protrusion 64. The interface flat portion 62 upward to a connection transition 65 where the left and right arms bend outward at the left and right arch bends 66.

Figure 16:
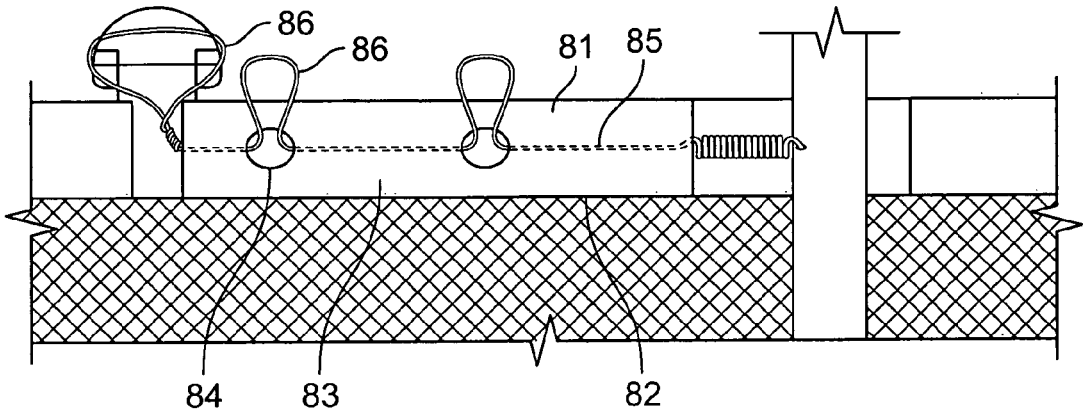
FIG. 16 is a diagram of an upper portion of the enclosure showing the enclosure top line member connecting between trampoline poles and having loops for connecting to an external horizontal structural member.
Figure 17:
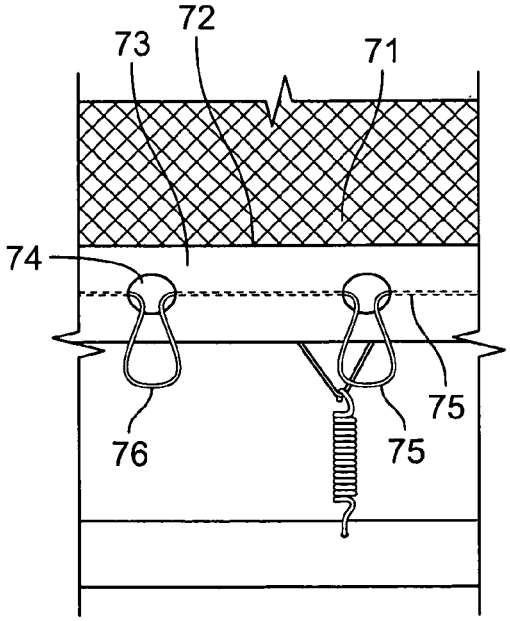
FIG. 17 is a diagram of a lower portion of the enclosure showing the lower portion of the trampoline enclosure net.
Figure 18:
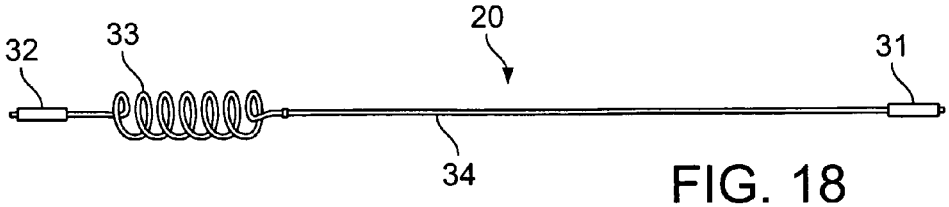
FIG. 18 is a diagram of an enclosure top line member.
Figure 19:
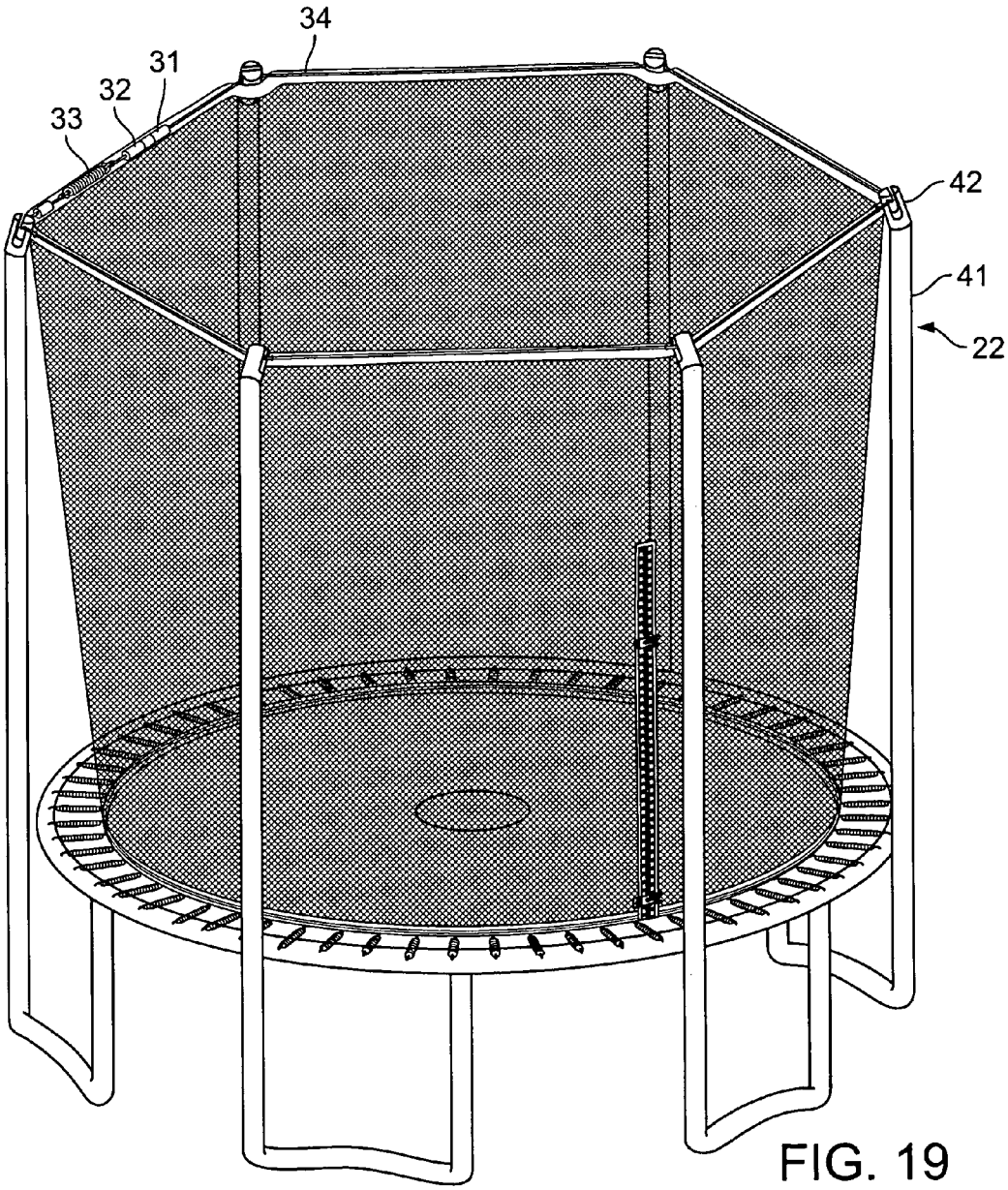
FIG. 19 is a diagram of the enclosure top line member installed to the trampoline poles.

The enclosure net can have a woven structure that retains a user by cushioning a user's fall. The enclosure net material is preferably flexible and at least partially elastic. The enclosure net has a mesh structure that is air permeable to allow wind to flow through the net. As seen in FIGS. 16-17, the mesh structure has a bottom seam 71 and a top seam. The enclosure net material can overlap and be folded into the bottom seam top edge 72 where the bottom seam top edge 72 has an elongated stitch that provides a connection between the bottom seam 71 and the enclosure net material above the bottom seam 71.

The bottom seam 71 can be reinforced by a bottom seam fabric reinforcing strip 73 that optionally has openings called bottom seam fabric reinforcing strip openings 74 for connecting to the trampoline bed, or to the trampoline bed springs connected between the trampoline bed and the trampoline frame. The bottom seam fabric reinforcing strip openings 74 can connect to the trampoline bed springs by passing a bottom seam elastic cord 75 through the bottom seam fabric reinforcing strip 73 so that the elastic cord can temporarily exit the bottom seam fabric reinforcing strip openings 74 for connecting to the trampoline bed springs. The bottom seam fabric reinforcing strip 73 circumferentially provides an encapsulation of an edge of the bottom seam 71. The bottom seam fabric reinforcing strip 73 preferably extends circumferentially around a perimeter or periphery of the trampoline and the bottom seam fabric reinforcing strip 73 can have round or rectangular bottom seam fabric reinforcing strip openings 74 that are connected to a connector such as the bottom seam elastic cord 75 formed in such a structure such as a rope, or a bungee shock cord, or a cable loop, for example. When the bottom seam elastic cord 75 exits the bottom seam fabric reinforcing strip opening 74, the bottom seam elastic cord 75 can form a loop such as a bottom seam elastic cord loop 76. Typically, a trampoline has a round profile, or a rounded square profile.

The top seam 81 can likewise be constructed so as to encapsulate a top edge of the mesh structure of the trampoline enclosure. The top seam 81 likewise has a top seam bottom edge 82 which serves as an interface between the top seam 81 and the enclosure net material. The top seam 81 is located above the mesh material of the trampoline enclosure.

The top seam 81 as a top seam fabric reinforcing strip 83 which can be made of the same type of material as the bottom seam fabric reinforcing strip 73. Both can have a heavy less flexible heavy-duty thick elongated fabric structure that is ultraviolet stabilized and stitched to the trampoline enclosure net material. The top seam fabric reinforcing strip 83 can also have top seam fabric reinforcing strip openings 84. The top seam fabric reinforcing strip openings 84 can allow a partially exposed top seam elastic cord 85 which can be partially pulled out to form a top seam elastic cord loop 86. The top seam elastic cord loop 86 is preferably biased toward the top seam fabric reinforcing strip openings. The top seam elastic cord loop 86 can fit over a top portion of a trampoline enclosure pole, and the top seam elastic cord loop 86 can snap into the top portion of the trampoline enclosure pole to be releasably retained to the trampoline enclosure pole.

The top seam fabric reinforcing strip openings 84 can be defined by grommets, or by a reinforced stitched opening. The reinforced stitched opening can be defined on a vertical edge opening of the top seam fabric reinforcing strip such as at a discontinuous portion of the top seam fabric reinforcing strip 83. The top seam fabric reinforcing strip 83 can be formed discontinuously in multiple sections or multiple top seam fabric reinforcing strips 83 can be disposed on the top seam 81.

Stitching of the top seam fabric reinforcing strip 83 and the bottom seam fabric reinforcing strip 73 can provide a sheath having an elongated hollow portion for respectively receiving a top seam elastic cord 85, or a bottom seam elastic cord 75. The top seam elastic cord 85 can loop onto a trampoline enclosure pole such as by engaging a hook portion of a plastic endcap fitted over an upper portion of the trampoline enclosure pole. When the top seam elastic cord 85 is connected to a portion of the plastic endcap, the trampoline enclosure net is suspended from the top seam elastic cord 85.

The top seam elastic cord 85 can be formed as an elastic cord having continuous elasticity, or an elastic having variable elastic in more than one section. The elastic cord can have an elastic cord first section and an elastic cord second section. The elastic cord first section can have a first elasticity and the elastic cord second section can have a second elasticity. The elastic cord first section can be a coil spring, and the elastic cord second section is less elastic nylon cord. The elastic cord first section can be an elastic bungee cord, and the elastic cord second section can be a nylon rope. The coil spring can be hooked directly to the trampoline enclosure pole or can connect to another section of the elastic cord that is connected to the trampoline enclosure pole.

The bottom seam elastic cord 75 can be formed as a rope or cord having an elasticity which can be equivalent to the elasticity of a nylon rope. The bottom seam elastic cord 75 preferably loops underneath the trampoline spring trampoline spring connector or underneath the trampoline spring. The trampoline spring is connected to the trampoline bed at a trampoline spring connector. When a user jumps on the trampoline bed, the trampoline spring connector increases in tension as the trampoline spring extends. The trampoline spring connector decreases in tension as the trampoline spring retracts to a neutral position. The top seam elastic cord 85 and the bottom seam elastic cord 75 can pull the trampoline enclosure to a generally suspended and tight configuration. The tight configuration is enabled by vertical tension along the trampoline enclosure net. Vertical tension extends between the top seam elastic cord 85 and the bottom seam elastic cord 75. The elastic cord can also be wrapped in a coil spring in the same fashion as a flexible polyethylene tube.

The trampoline bed also has a tension, namely a trampoline bed tension because the trampoline bed is extended horizontally across the horizontal trampoline frame section. The horizontal tension of the trampoline bed provides a vertical bias upward to propel a user. The vertical tension of the trampoline enclosure net may or may not add to this vertical bias upward when the trampoline bed is deflected downward by a user.

The invention claimed is:

1. A composite trampoline enclosure system having: a trampoline with a trampoline frame and a trampoline bed; a trampoline enclosure mounted to the trampoline, wherein the trampoline enclosure further includes: an enclosure pole formed as a tubular post; an endcap, wherein the endcap fits over the tubular post; a trampoline enclosure netting extended around the trampoline bed, where the trampoline enclosure netting is supported by the trampoline pole, wherein the improvement is:

a. a flexible top line made of polypropylene or polyethylene, wherein the flexible top line connects to the endcap, wherein the flexible top line supports the trampoline enclosure netting, wherein the flexible top line is formed as a flexible top rod; and b. an extended coil spring whipped, in a helical orientation, around an external surface of the flexible top line, wherein the extended coil spring has a pretension against the flexible top rod when mounted to the flexible top rod.

2. The composite trampoline enclosure system of claim 1, wherein the extended coil spring is made of spring steel.

3. The composite trampoline enclosure system of claim 1, wherein the flexible top line is made of a high density polyethylene tube.

4. The composite trampoline enclosure system of claim 1, wherein the flexible top line comprises high density polyethylene.

5. The composite trampoline enclosure system of claim 1, wherein the flexible top line made of high density polyethylene is made with a coil spring slot formed as a helical groove along at least a portion of the length of the flexible top line, wherein the coil spring slot receives the coil spring that is extended into the coil spring slot.

6. The composite trampoline enclosure system of claim 5, further including an epoxy coating applied over the coil spring slot after the coil spring is extended into the coil spring slot.

* * * * *